United States Patent [19]

Sherman et al.

[11] 4,385,744

[45] May 31, 1983

[54] ANTI-THEFT FRAME HANGING SYSTEM

[75] Inventors: Charles F. Sherman, Townsend; Mark T. Cole, Acton, both of Mass.; Helmar Nielsen, Manchester, N.H.

[73] Assignee: Nielsen Moulding Design Corporation, Townsend, Mass.

[21] Appl. No.: 239,392

[22] Filed: Mar. 2, 1981

[51] Int. Cl.[3] ..... F16M 13/100

[52] U.S. Cl. ..... 248/551; 40/152.1

[58] Field of Search ..... 40/152, 152.1, 10 R; 248/551, 489

[56] References Cited

U.S. PATENT DOCUMENTS

| | | | |
|---|---|---|---|
| 1,883,834 | 10/1932 | Turner | 40/152.1 |
| 2,900,750 | 8/1959 | Buelow | 40/152.1 |
| 2,928,199 | 3/1960 | Novak | 40/152.1 |
| 3,668,798 | 6/1972 | Mehl | 40/152.1 |

*Primary Examiner*—Gene Mancene
*Assistant Examiner*—Wenceslao J. Contreras
*Attorney, Agent, or Firm*—John E. Toupal; Harold G. Jarcho

[57] ABSTRACT

The invention is a frame apparatus including a frame body for retaining a display article and a securing system fixed to a support surface and detachably engageable with the rear surface of the frame body. The securing system includes a latch assembly attaching the frame body to the support surface and having a release mechanism concealed therebetween.

18 Claims, 6 Drawing Figures

ANTI-THEFT FRAME HANGING SYSTEM

BACKGROUND OF THE INVENTION

This invention relates generally to frame apparatus and, more particularly, to frame apparatus that can be locked in position on a support surface.

Art work is commonly displayed in many facilities to which the public has access and including, for example, office buildings, art galleries, museums, etc. Typically, the art work is retained by frames that are mounted on wall surfaces and the theft of such publicly displayed articles is an ever-increasing problem. Conventional hanging systems permit quick removal of frame retained art work that then can be concealed and removed from a facility in which it was displayed.

The object of this invention, therefore, is to provide a hanging system that will deter the unauthorized removal of frame retained articles from a support surface.

SUMMARY OF THE INVENTION

The invention is a frame apparatus including a frame body for retaining a display article and a securing system fixed to a support surface and detachably engageable with the rear surface of the frame body. The securing system includes a latch assembly attaching the frame body to the support surface and having a release mechanism concealed therebetween. Because the latch release mechanism is concealed from view, unauthorized removal of the frame body from the support surface is deterred.

According to a preferred embodiment of the invention, the system includes an actuator key with a handle portion and an actuator portion shaped for passage between the support surface and the frame body to engage the release mechanism. The requirement for a specially shaped actuator key further deters the unauthorized removal of the frame body.

According to one feature of the invention, the securing system includes a plurality of spaced apart catches that are secured to the support surface and releasably engage spaced apart retainers defined by the frame body. One of the catches encompasses the latch which is movable between a locked position that prevents relative perpendicular movement between the frame body and the support surface and a release position that permits such movement. The plurality of spaced apart catches securely lock the frame body in position but permit easy detachment thereof after release of the single latch assembly.

Another feature of the invention is the provision of a frame body having rearwardly facing channels with inwardly extending lips. The catches are shaped and arranged to engage the inner surfaces of the lips and thereby prevent relative perpendicular movement between the frame body and the support surface.

According to yet another feature of the invention, the latch assembly includes a latch body received by the frame channel, a pivot member retained by the latch body and pivotally movable between the locked and release positions, and a spring member biasing the pivot member in the locked position. The pivot member comprises a locking portion that engages an inner surface of one of the lips when in its locked position and a release portion that can be engaged by the actuator and pivoted thereby into its release position. In the release position, the locking portion is disengaged from the inner surface of the lip to permit separation of the channel and the latch body.

Still another feature of the invention is the provision on the pivot member of a cam portion that engages an outer surface of the lip and is forced thereby into its release position during movement of the locking portion into the channel. The cam portion facilitates automatic locking of the latch assembly during positioning of the frame body on the support surface.

According to still another feature of the invention, the latch body defines a chamber that retains the release portion and the actuator portion of the actuator comprises a mid-portion for passage between the frame body and the support surface, a first projection portion for entering the channel and extending transversely from the mid-portion, and a second projection portion extending from the first projection portion and adapted to enter the chamber and engage the release portion of the latch. The geometry of the latch body and actuator are such as to prevent release of the latch by a common implement not specially suited for that use.

DESCRIPTION OF THE DRAWINGS

These and other objects and feature of the invention will become more apparent upon a perusal of the following description taken in conjunction with the accompanying drawings wherein.

DESCRIPTION OF THE PREFERRED EMBODIMENT

Figure 1:
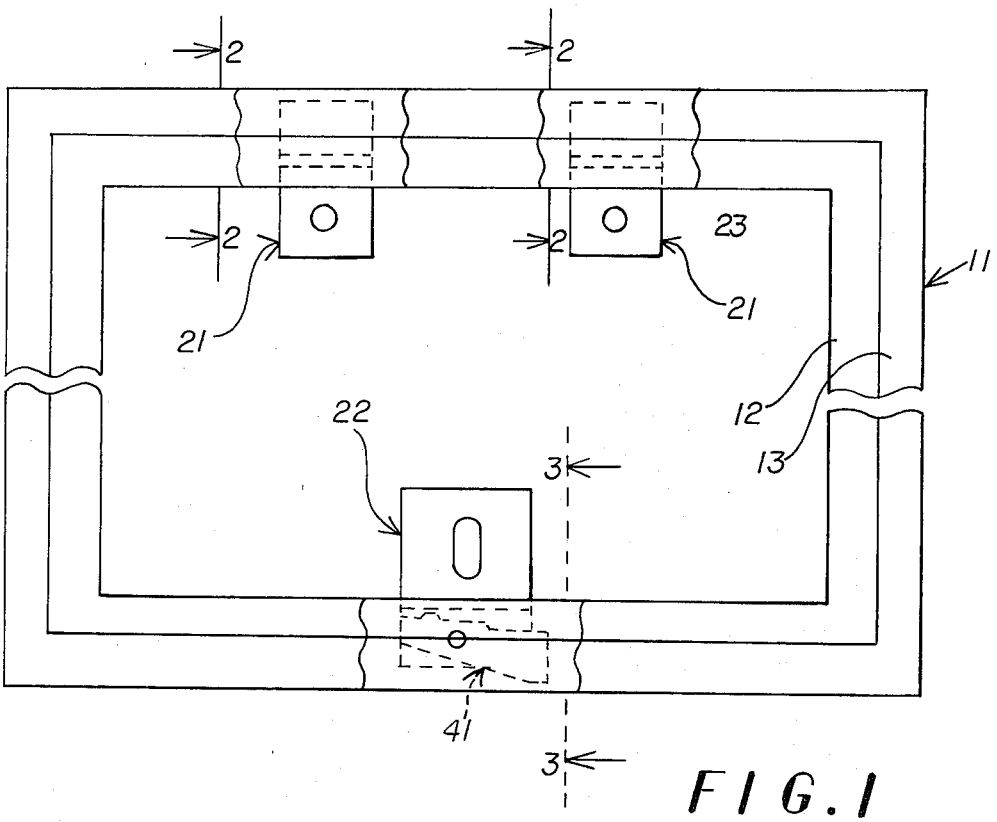
FIG. 1 is a schematic front view of a frame apparatus according to the invention.
Figure 2:
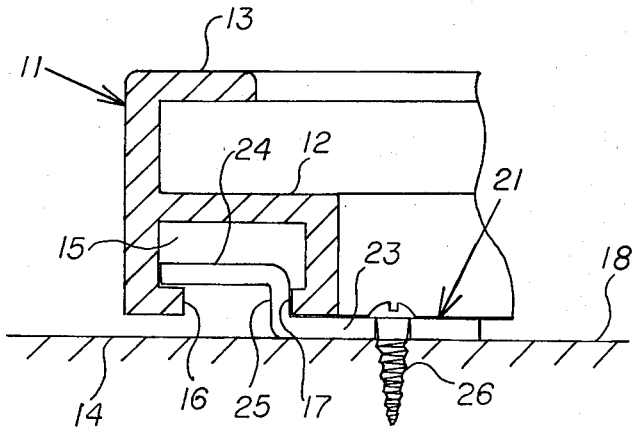
FIG. 2 is a partial cross-sectional view taken along lines 2—2 of FIG. 1.
Figure 3:
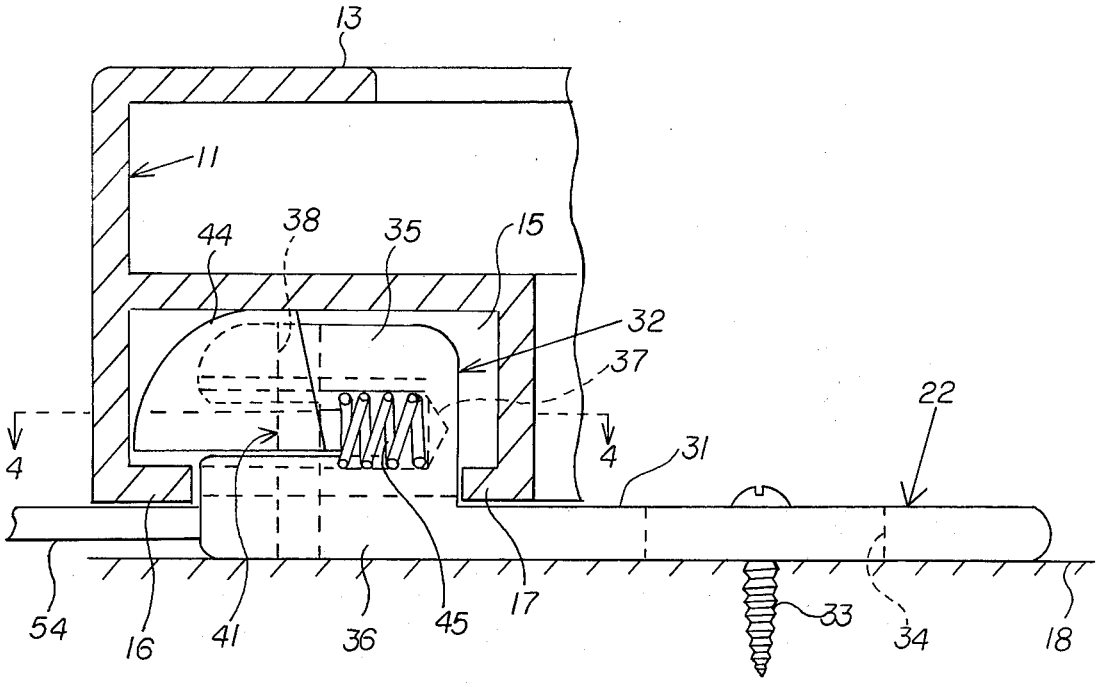
FIG. 3 is a partial schematic cross-sectional view taken along lines 3—3 of FIG. 1.

Illustrated in FIG. 1 is a rectangular frame body 11 having a base surface 12 and a border portion 13 adapted to straddle a display article (not shown) such as art work. As shown in FIGS. 2 and 3, a rear surface 14 of the frame body 11 defines a continuous, rearwardly facing channel 15 terminated by inwardly extending lips 16, 17. The frame body 12 per se is conventional and is of the type disclosed in U.S. Pat. No. 4,122,617.

A system for securing the frame 11 to a support surface 18 includes a pair of spaced apart bracket catches 21 located on a top leg of the frame body 11 and a latching catch 22 located on a bottom leg thereof. As shown in FIG. 2, each of the brackets 21 includes a base portion 23 and a parallel flat holder portion 24 joined by an orthogonal mid-portion 25. The base portions 23 are secured to the support surface 18 by screws 26, the mid-portions 25 extend into the channel 15, and the outer edges of the holder portions 24 are retained by the outer inwardly extending lip 16.

Figure 4:
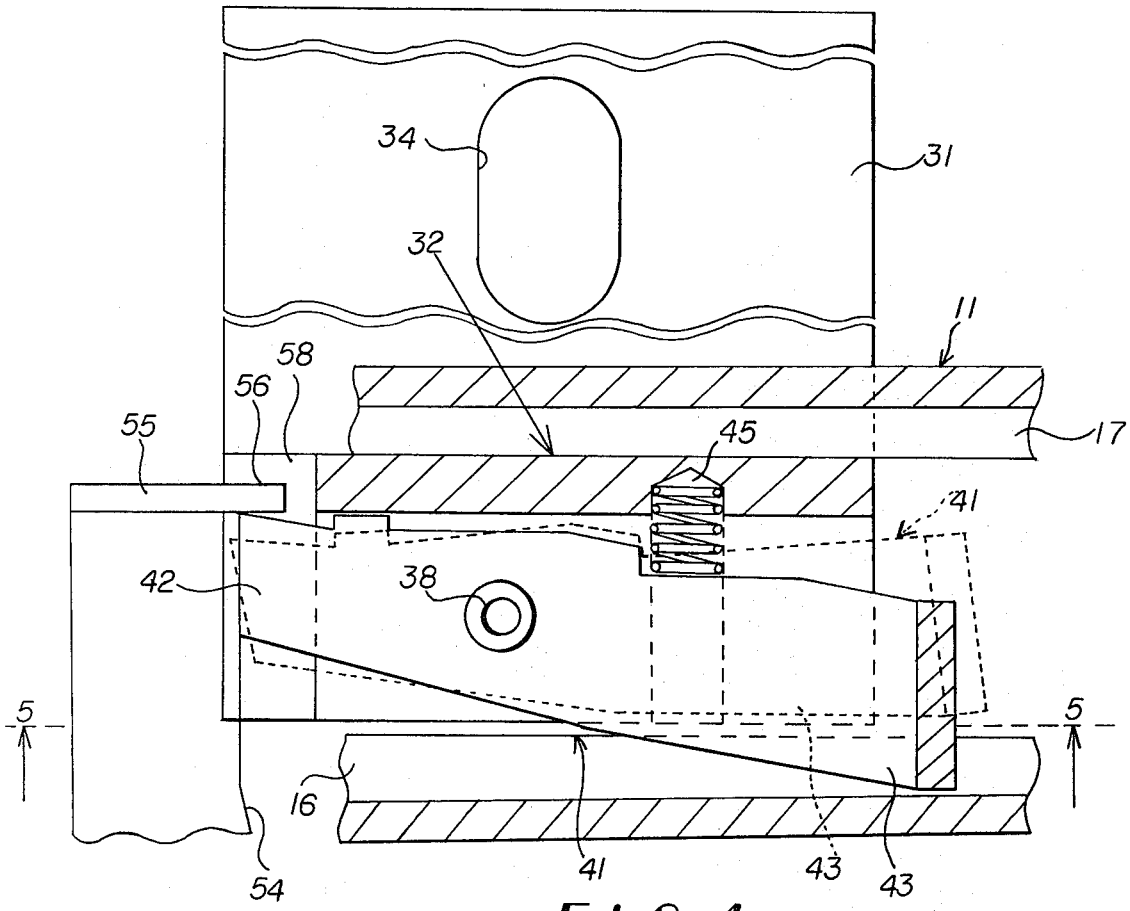
FIG. 4 is a schematic cross-sectional view taken along lines 4—4 of FIG. 3.
Figure 5:
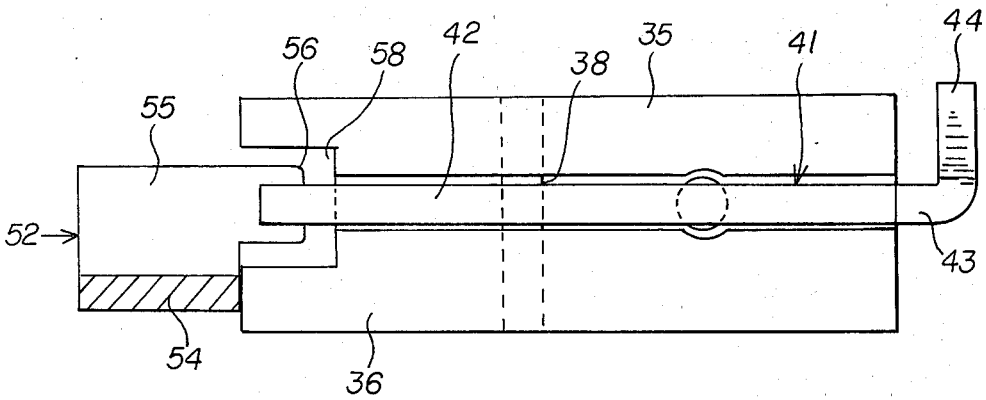
FIG. 5 is a schematic cross-sectional view taken along lines 5—5 of FIG. 4.

As shown in FIGS. 3–5, the latch assembly 22 includes a flat base portion 31 and a latch body portion 32 that extends into the channel 15. Securing the latch assembly 22 to the support surface 18 is a screw 33 extending through an elongated alignment opening 34 in the base portion 31. The latch body 32 is formed by a pair of bifurcated legs 35, 36 joined at one end by a connecting portion 37. Pivotally retained between the leg portions 35, 36 by a pin 38 is a pivot member 41 movable between a locked position shown by solid lines and a release position shown by dotted lines in FIG. 4. The pivot member 41 includes a release portion 42 located on one side of the pin 38 and a locking portion 43 located on the opposite side thereof. Extending orthogonally from the end of the locking portion 43 is a curved cam portion 44 shown most clearly in FIG. 3.

A spring member 45 positioned between the locking portion 43 and the connecting portion 37 of the latch body 32 biases the pivot member 41 into the locked position shown by solid lines in FIG. 4. When in that locked position, the locking portion 43 extends over the inner surface of the outer lip 16 so as to retain the latch body 32 within the channel 15. It will be obvious that the three positions of engagement between the fixed catches 21, 22 and the frame body 11 prevent movement thereof in a direction perpendicular to the surface 18. Furthermore, horizontal movement of the frame member 11 on the catches 21, 22 in a plane parallel to the surface 18 is limited in opposite directions by engagement between one of the brackets 21 and a corresponding upper corner of the frame member 11. Thus, with the pivot member 41 of the latch assembly 32 in its locked position, the frame body 11 cannot be removed from the support surface 18.

To mount the frame 11, the brackets 21 are first secured to the support surface 18 in horizontally aligned positions at the desired elevation. The latch assembly 22 is then fixed to the surface 18 in a position between the brackets 21 and vertically spaced therefrom a distance determined by the length of the frame body 11. The elongated opening 34 in the latch base portion 31 is used to provide required vertical positioning of the latch assembly 22. With the catch members 21, 22 in position on the surface 18, the top leg of the frame body 11 is engaged to the bracket members 21. This engagement is facilitated by tilting the bottom portion of the frame body 11 away from the support surface 18 so as to permit entry of the holder portions 24 into the channel 15 (FIG. 2). The bottom leg of the frame body 11 is then moved toward the surface 18 until the cam portion 44 of the pivot member 41 (FIG. 3) engages the outer surface of the outer lip 16. Further inward movement of the frame body 11 cams the pivot member 41 into the release position shown by dotted lines in FIG. 4 as the latch body 31 enters the channel 15. After movement of the pivot member 41 by the outer lip 16, the spring member 45 forces the pivot member 41 back into its locked position shown by solid lines in FIG. 4. In that position the locking portion 43 is engageable with the inner surface of the outer lip 16 so as to substantially restrict relative perpendicular movement between the frame body 11 and the surface 18.

Figure 6:
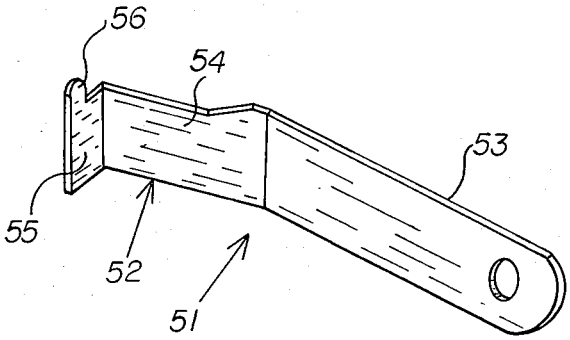
FIG. 6 is a schematic perspective view of an actuator key for use with the latch assembly shown in FIGS. 3–5.

Referring now to FIG. 6, there is illustrated an actuator key 51 for use in removing the frame body 11 from the support surface 18. The key 51 comprises an actuator portion 52 joined at an angle to a handle portion 53. Forming the actuator portion 52 is a planar mid-portion 54, a first projection portion 55 extending orthogonally therefrom and a second projection portion 56 extending from the first portion 55 in a direction parallel to the planar mid-portion 54.

During removal of the frame body 11, the handle portion 53 of the key 51 is manipulated to pass the mid-portion 54 between the rear surface of the frame and the support surface 18 as shown in FIG. 3. After being positioned between the frame 11 and the surface 18 the actuator 51 is moved toward the latch body 32 into the relative position indicated in FIG. 4. During this latter movement, the second projection portion 56 enters a chamber 58 formed between the bifurcated legs 35, 36 and moves behind the release portion 42 of the pivot member 41. Subsequent outward movement of the actuator 51 first produces engagement between the second projection portion 56 and the release portion 42 and then moves the pivot member 41 into the release position shown by dotted lines in FIG. 4. The bottom leg of the frame body 11 can then be moved away from the latch body 32. After separation of the channel 15 and the latch body 32, the top leg portion of the frame body 11 is easily disengaged from the brackets 21 permitting removal of the frame body 11 from the support surface 18.

It will be noted that the release portion 42 of the latch assembly 32 is positioned behind the frame body 11 so as to be concealed from the view of a potential thief. In addition, the shaping and arrangement of the latch body 32 renders the release portion 42 mechanically accessible only to an implement having a particular shape of the actuator key 51. For those reasons, removal of the frame body 11 is not possible by one unfamiliar with the latch assembly 22 or not in possession of a suitable actuator 51.

Obviously, many modifications and variations of the present invention are possible in light of the above teachings. It is to be understood, therefore, that the invention can be practiced otherwise than as specifically described.

What is claimed is:

1. A frame apparatus comprising:

a frame body adapted to retain a display article and having a rear surface for attachment to a support surface;

securing means comprising releasable latch means for attaching said rear surface to the support surface and movable between locked and release positions, said latch means preventing removal of said frame body from the support surface when in said locked position and allowing removal thereof when in said release position, said latch means comprising bias means biasing said latch means into said locked position and release means operable to move said latch means into said release position to allow removal of said frame body, and wherein said release means is disposed between and substantially concealed by said frame body and the support surface.

2. Apparatus according to claim 1 wherein said securing means is adapted to be fixed to the support surface and to detachably engage said rear surface so as to prevent any substantial relative movement therebetween in a direction perpendicular to the surface.

3. Apparatus according to claim 2 including an actuator having a handle portion and an actuator portion, said actuator being adapted for manual manipulation whereby said actuator portion passes between the support surface and said rear surface to contact said release means and release said latch means.

4. Apparatus according to claim 2 wherein said securing means comprises a plurality of spaced apart catch means for mounting on the support surface; and said rear surface defines a plurality of spaced apart retainer means each adapted to releasably engage one of said catch means.

5. Apparatus according to claim 4 wherein said latch means comprises one of said catch means movable between said locked and release positions, said one catch means adapted to engage one of said retainer means and prevent said relative movement when in said locked position and to permit said relative movement when in said release position.

6. Apparatus according to claim 5 wherein said one retainer means defines a retainer cavity, and said rear surface and said latch means are shaped and arranged such that during movement of said frame body into position on the support surface said rear surface first engages and moves said one catch means into said release position and then permits said bias means to move said one catch means into its said locked position and within said retainer cavity.

7. Apparatus according to claim 6 wherein said catch means further comprise bracket means, and said retainer means further comprises receptacle means for releaseably engaging said bracket means.

8. Apparatus according to claim 7 wherein said rear surface defines rearwardly facing channels terminating with inwardly extending lips, and said channels and said lips comprise said retainer cavity and said receptacle means.

9. Apparatus according to claim 8 including an actuator having a handle portion and an actuator portion, said actuator being adapted for manual manipulation whereby said actuator portion passes between the support surface and said rear surface to contact said release means and release said latch means.

10. A frame apparatus comprising:

a frame body adapted to retain a display article and having a rear surface for attachment to a support surface, said rear surface defining rearwardly facing channels terminating with inwardly extending lips;

securing means comprising a plurality of spaced apart catch means mounted on the support surface and adapted to releasably engage inner surfaces of said lips, one of said catch means comprising latch means movable between locked and release positions, said latch means preventing any substantial relative movement between said rear surface and the support surface when in said locked position and permitting said relative movement when in said release position, said latch means comprising release means operable to move said latch means into said release position to allow removal of said frame body, and wherein said release means is disposed between and substantially concealed by said frame body and the support surface.

11. Apparatus according to claim 10 including an actuator having a handle portion and an actuator portion, said actuator being adapted for manual manipulation whereby said actuator portion passes between the support surface and said rear surface to contact said release means and release said latch means.

12. Apparatus according to claim 1 wherein said latch means comprises bias means biasing said one catch means into said locked position.

13. Apparatus according to claim 12 including an actuator having a handle portion and an actuator portion, said actuator being adapted for manual manipulation whereby said actuator portion passes between the support surface and said rear surface to contact said release means and release said latch means.

14. Apparatus according to claim 13 wherein said latch means comprises a latch body, said one catch means comprises a pivot member pivotally retained by said latch body, said pivot member defining a locking portion adapted to engage an inner surface of one of said lips when in said locked position, and said release means comprises a release portion of said pivot member adapted to be engaged by said actuator portion and pivoted thereby into said release position wherein said locking portion is disengaged from said inner surface of said one lip.

15. Apparatus according to claim 14 wherein said pivot member comprises a cam portion adapted to engage an outer surface of said one lip and be forced thereby into said release position during movement of said locking portion into one of said channels.

16. Apparatus according to claim 15 wherein said catch means further comprise bracket means spaced from said latch means and releasably engageable with inner surfaces of said lips.

17. Apparatus according to claim 16 wherein said latch body defines a chamber retaining said release portion, and said actuator portion comprises a planar mid-portion for passage between said frame body and the support surface, a first projection portion for entering said channel and extending transversely from said mid-portion and a second projection extending from said first projection portion in a direction parallel to said mid-portion and adapted to enter said chamber and engage said release portion.

18. Apparatus according to claim 17 wherein said handle portion is angularly inclined to said actuator portion.

* * * * *